US007450075B2

(12) United States Patent
Kim et al.

(10) Patent No.: US 7,450,075 B2
(45) Date of Patent: Nov. 11, 2008

(54) BROADCASTING RECEIVING ANTENNA SYSTEM MOUNTED IN A WIRELESS TERMINAL

(75) Inventors: Yong-jin Kim, Seongnam-si (KR); Young-eil Kim, Suwon-si (KR); Ick-jae Yoon, Seoul (KR)

(73) Assignees: Samsung Electronics Co., Ltd., Suwon-si (KR); Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 11/637,031

(22) Filed: Dec. 12, 2006

(65) Prior Publication Data

US 2007/0273591 A1 Nov. 29, 2007

(30) Foreign Application Priority Data

May 24, 2006 (KR) ..... 2006-46365

(51) Int. Cl.
*H01Q 1/24* (2006.01)

(52) U.S. Cl. ..... 343/702; 343/900

(58) Field of Classification Search ..... 343/702, 343/725, 846, 900
See application file for complete search history.

(56) References Cited

U.S. PATENT DOCUMENTS

| | | | | |
|---|---|---|---|---|
| 6,812,897 | B2 * | 11/2004 | Jarmuszewski et al. | ..... 343/702 |
| 2002/0000941 | A1 | 1/2002 | Johnson | |
| 2006/0012529 | A1 | 1/2006 | Mattsson et al. | |

FOREIGN PATENT DOCUMENTS

| | | | |
|---|---|---|---|
| EP | 0977367 | A2 | 2/2000 |
| EP | 1067624 | A1 | 1/2001 |
| EP | 1182727 | A2 | 2/2002 |
| EP | 1638227 | A2 | 3/2006 |
| GB | 2373638 | A | 9/2002 |

* cited by examiner

*Primary Examiner*—Hoang V Nguyen
(74) *Attorney, Agent, or Firm*—Sughrue Mion, PLLC

(57) ABSTRACT

A broadcast receiving antenna system mounted in a wireless terminal. The antenna is bendable, and functions as a PIFA antenna or a monopole whip antenna according to whether it is bent or not. Accordingly, since the length and the type of the antenna are adjustable according to the magnitude of the DMB or DVB-H signal, optimum broadcasting services can be provided and the length of the antenna can be shortened. Ultimately, Intenna-type antenna can be mounted.

16 Claims, 5 Drawing Sheets

BROADCASTING RECEIVING ANTENNA SYSTEM MOUNTED IN A WIRELESS TERMINAL

CROSS-REFERENCE TO RELATED APPLICATIONS

This application claims priority from Korean Patent Application No. 10-2006-0046365 filed May 24, 2006, in the Korean Intellectual Property Office, the entire disclosure of which is incorporated herein by reference.

BACKGROUND OF THE INVENTION

1. Field of the Invention

Systems consistent with the present invention relate to a broadcast receiving antenna system mounted in a wireless terminal. More particularly, the present invention relates to a broadcast receiving antenna system mounted in a wireless terminal, capable of providing optimum services and shortening the antenna length by adjusting the length of the radiating part according to magnitude of electromagnetic waves.

2. Description of the Related Art

With the recent advance of mobile communication technology, mobile terminals are providing various services that have until now been available only in limited places such as the home or office.

Among the various services, digital multimedia broadcasting (DMB) services are a new concept of mobile multimedia broadcasting service with a convergence of communication and broadcasting. DMB services are provided through wireless mobile terminals such as dedicated DMB terminals, notebook computers, mobile phone terminals, vehicle mounted terminals, personal digital assistants (PDAs), and portable multimedia players (PMPs). DMB services can be divided into satellite DMB services and terrestrial DMB services.

Terrestrial DMB services use a frequency band of 176~212 MHz, and satellite DMB services use an S-band of 2.630~2.655 GHz, which is higher than the terrestrial DMB band.

Typically, the length of dipole antennas is $\lambda/2$, and that of monopole antennas is $\lambda/4$. Accordingly, shorter antennas are used for higher frequency bands, and longer antennas are used for lower frequency bands. Since terrestrial DMB services use the VHF band commonly used for broadcasts, in theory they need antennas that are longer than those used for satellite DMB services and similar in length to TV antennas. Hence, terrestrial DMB services require antennas longer than about 30 cm. When the antenna output is high, the antenna may be shorter.

Terrestrial DMB services have a very small output of about 1~2 KW because they use taboo channels 8, 10 and 12. Since channel 8, which is between channel 7 and channel 9, causes radio interference to affect neighboring channels when its output is increased, it is hard to raise the output of channel 8. However, since such an antenna is mounted in a wireless terminal which features portability and mobility, it is inconvenient to use a longer antenna.

Thus, the most urgent task of antenna developers is to shorten the length of the terrestrial DMB antenna while maintaining the reception sensitivity. Up until now it has been widely believed to be almost impossible to produce terrestrial DMB antenna below 15 cm in length.

Terrestrial DMB antennas are inevitably long because they are designed to be suitable for conditions of average reception sensitivity. However, when the reception sensitivity is good, the antenna does not need to be long. Conventional antennas are inevitably quite long because the length of the antenna is fixed.

Meanwhile, digital video broadcasting-terrestrial (DVB-T) is a digital TV broadcasting standard, which has been developed and used mostly in Europe. Digital video broadcasting-handhelds (DVB-H) are DVBs based on the DVB-T, taking into account the low power, mobility, and portability of mobile phones or portable video devices. It can be said that the DVB-H is almost equivalent to terrestrial DMB. As the DVB-H utilizes a relatively low frequency band, it generally suffers the same problems as the terrestrial DMB antenna.

Therefore, it is necessary to shorten the length of the antenna and mount the antenna in the device by adjusting the length of the antenna for receiving terrestrial DMB or the DVB-H.

SUMMARY OF THE INVENTION

Illustrative, non-limiting exemplary embodiments of the present invention overcome the above disadvantages, and other disadvantages not described above.

An aspect of the present invention provides a broadcast receiving antenna system which is mounted in a wireless terminal, to shorten the length of the antenna by making the length of the antenna adjustable.

An apparatus consistent with the present invention provides a broadcast receiving antenna which is mounted in a wireless terminal and is bendable to operate as a planar inverted F antenna (PIFA) or a monopole whip antenna according to whether the broadcast receiving antenna is bent or not.

The broadcast receiving antenna according to an exemplary embodiment of the present invention includes a ground, a radiating part which is in a bar shape and is bendable, a feeding part which is connected to the ground and provides current to the radiating part, and a shorting part which forwards current circulating the radiating part to the ground.

The ground may be a display panel of the wireless terminal.

The radiating part includes a first radiating part and a second radiating part which are connected by a hinge, and the first radiating part and the second radiating part rotatably moved by the hinge between a folded position where the second radiating part is bent toward the first radiating part, and an unfolded position where the first radiating part and the second radiating part are on the same line.

The radiating part may comprise a first radiating part and a second radiating part, and the radiating part may further comprise a hinge installed on an area connecting the first radiating part and the second radiating part, and a hinge motor installed to a hinge shaft to rotatably move between a folded position where the second radiating part is bent toward the first radiating part and an unfolded position where the first radiating part and the second radiating part are on the same line.

According to an aspect of exemplary embodiment of the present invention, an electromagnetic detector which detects magnitude of received electromagnetic waves; and an antenna controller which controls the extension of the radiating part according to the magnitude detected at the electromagnetic detector, may be further provided.

The antenna controller may unfold the radiating part by driving the hinge motor when the magnitude detected at the electromagnetic detector is below a preset level.

A switch may be interposed between the shorting part and the ground.

The antenna controller may control to operate as the monopole antenna by turning off the switch when the radiating part is in the unfolded position.

The first radiating part may be placed inside the wireless terminal, and the second radiating part is extendable out of the wireless terminal.

According to an aspect of an exemplary embodiment of the present invention, a broadcast receiving antenna system mounted to a wireless terminal may comprise a radiating part which is in a bar shape and bendable, a feeding pin which is connected to an end of the radiating part to provide current to the radiating part, and coupled to a plug formed to the wireless terminal to connect to a ground, and a shorting pin which is connected to an end of the radiating part to provide current circulating the radiating part to the ground, connectable to the ground through a plug formed to the wireless terminal, and connectable to or disconnectable from the ground according to the length of the radiating part.

The radiating part may include a first radiating part and a second radiating part, and the radiating part may further comprise a hinge which connects the first radiating part and the second radiating part to rotatably move the radiating part between a folded position where the second radiating part is bent toward the first radiating part and an unfolded position where the first radiating part and the second radiating part are on the same line.

The second radiating part may have a smaller width than the first radiating part to be accommodated by the first radiating part, and extends or retracts between an interior and an exterior of the first radiating part.

According to an aspect of an exemplary embodiment of the present invention, an electromagnetic detector which detects magnitude of received electromagnetic waves; an antenna controller which determines whether to unfold the radiating part according to the magnitude detected at the electromagnetic detector; and a display controller which displays a message requesting the extension of the radiating part on a display panel under control of the antenna controller, may be further provided.

The antenna controller may control the display controller to display a message which requests the extension of the second radiating part and the disconnection of the shorting pin from the plug when the magnitude detected at the electromagnetic detector is below a preset level.

A switch may be interposed between the plug coupled to the feeding pin, and the ground.

The antenna controller may control the display controller to display a message which requests the extension of the second radiating part, and turns off the switch when the magnitude detected at the second detector is below a preset level.

BRIEF DESCRIPTION OF THE DRAWING FIGURES

These and/or other aspects of the present invention will become more apparent and more readily appreciated from the following description of exemplary embodiments thereof, with reference to the accompanying drawings, in which.

DETAILED DESCRIPTION OF EXEMPLARY EMBODIMENTS

Figure 1:
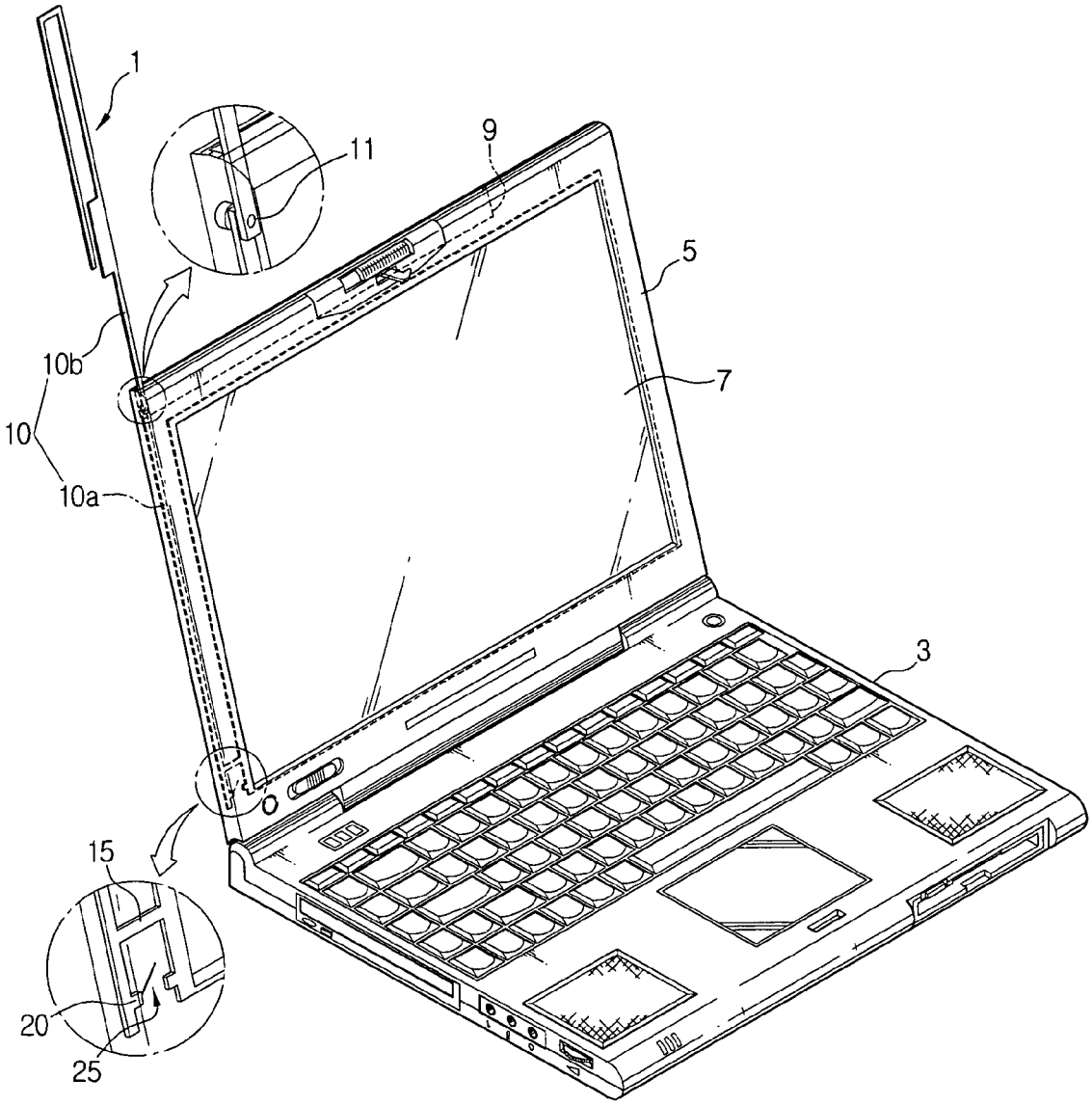
FIG. 1 is a perspective view of a notebook computer in which an antenna is mounted according to an exemplary embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

A broadcast receiving antenna according to an exemplary embodiment of the present invention is mounted in a wireless terminal capable of providing broadcast services such as DMB service or DVB-H service. The broadcast receiving antenna can be embedded in the wireless terminal as an Intenna (Internal antenna), or detachably attached to the exterior of the wireless terminal. It is possible to adjust the length of the antenna automatically, semi-automatically, or manually as the user uses the DMB service or the DVB-H service.

The antenna can be mounted in a portable wireless terminal, for example, a dedicated DMB terminal, a dedicated DVB-H terminal, a notebook computer, a portable terminal, a vehicle mounted terminal, a PDA, and a PMP. The following descriptions will exemplify a notebook computer.

FIG. 1 is a perspective view of a notebook computer in which an antenna is mounted according to one embodiment of the present invention.

As shown in FIG. 1, the notebook computer includes a main body 3 where a keyboard is installed, and a cover 5 where a display panel 7 is installed. An antenna 1 is mounted in the cover 5.

The antenna 1 includes a radiating part 10 for radiating electromagnetic waves, a feeding part 15 for providing current to the radiating part 10, a shorting part 20 for forwarding the circulating current of the radiating part 10 to a ground, and the ground. The ground can be provided separately or alternatively, the display panel 7 may be used as the ground. In an aspect of the exemplary embodiment of the present invention, the display panel 7 is used as the ground.

The radiating part 10 is formed in a bar shape. The radiating part 10 may include a first radiating part 10*a* and a second radiating part 10*b*. The first radiating part 10*a* is mounted within the cover 5 and connected to the display panel 7 through the feeding part 15 and the shorting part 20. The second radiating part 10*b* is extended from an end of the first radiating part 10*a* and can be unfolded out of the cover 5. The second radiating part 10*b* is bent toward the first radiating part 10*a* to be in parallel with one side of the cover 5. A free end of the second radiating part 10*b* is bent in a ⊏shape. An elongated recess 9 is formed at the cover 5 of the notebook computer along the longitudinal direction of the second radiating part 10*b* to accommodate the second radiating part 10*b*.

A hinge 11 is disposed in the area connecting the first radiating part 10*a* and the second radiating part 10*b*. A hinge motor (not shown) is mounted at a hinge shaft to drive the hinge 11. Depending on the driving of the hinge motor, the second radiating part 10*b* moves between a folded position where the first radiating part 10*a* and the second radiating part 10*b* stand perpendicularly to each other, and an unfolded position where the first radiating part 10*a* and the second radiating part 10*b* are arranged in a straight line. In the folded position, the second radiating part 10*b* is accommodated by the recess 9. In the unfolded position, the second radiating part 10*b* protrudes to the outside of the cover 5.

It should be understood that a user can manually rotate the second radiating part 10*b* between the folded position and the unfolded position, without having to separately install the hinge motor to the hinge shaft.

The feeding part 15 and the shorting part 20 interconnect the first radiating part 10*a* and the display panel 7. A switch 25 is interposed between the shorting part 20 and the display panel 7 to switch on and off between them. The switch 25 is turned on or off according to the folded position or the unfolded position of the second radiating part 10*b*. When the second radiating part 10*b* is in the folded position, the switch 25 is turned on so as to interconnect the shorting part 20 and the display panel 7. At this time, the antenna 1 functions as a planar inverted F antenna (PIFA). By contrast, when the second radiating part 10*b* is in the unfolded position, the switch 25 is turned off so as to disconnect the shorting part 20 from the display panel 7. At this time, the antenna 1 functions as a monopole whip antenna.

Figure 2:
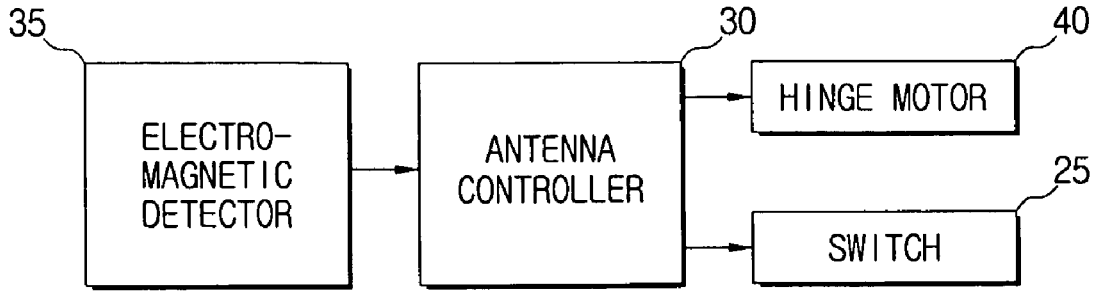
FIG. 2 is a block diagram of a control system for the notebook computer to automatically control the operation of the antenna of FIG. 1.

FIG. 2 is a block diagram of a control system for the notebook computer to automatically control an operation of the antenna 1 of FIG. 1.

The control system of the antenna 1 includes an electromagnetic detector 35 for detecting electric field of the electromagnetic waves received via the antenna 1, and an antenna controller 30 for controlling the withdrawal of the second radiating part 10*b*, and ON and OFF of the switch 25 according to the detection result of the electromagnetic detector 35.

When the magnitude detected by the electromagnetic detector 35 is below a preset level, the antenna controller 30 controls to draw out the second radiating part 10*b* in order to increase the magnitude. Specifically, the antenna controller 30 controls to move the second radiating part 10*b* from the folded position to the unfolded position by driving the hinge motor 40. Simultaneously, the antenna controller 30 controls the antenna 1 to function as the monopole antenna by turning off the switch 25 and thus disconnecting the shorting part 20 from the display panel 7.

An operation of the antenna 1 constructed above according to one exemplary embodiment of the present invention will now be described.

When the user decides to use the DMB or DVB-H service after operating the notebook computer, radio signals for the DMB or DVB-H service is input via the antenna 1.

Initially, the antenna 1 is in the folded position such that the second radiating part 10*b* is placed in the recess 9. At this time, when the radio signals are received, the electromagnetic detector 35 detects the electric field of the radio signals and provides the detection result to the antenna controller 30.

When the magnitude detected by the electromagnetic detector 35 is below the preset level, the antenna controller 30 drives the hinge motor 40 to move the second radiating part 10*b* to the unfolded position and turns off the switch 25 so that the antenna 1 functions as the monopole antenna.

By contrast, when the magnitude detected by the electromagnetic detector 35 is above the preset level, the antenna controller 30 maintains the folded position of the second radiating part 10*b* so that the antenna 1 functions as the PIFA.

Figure 3:
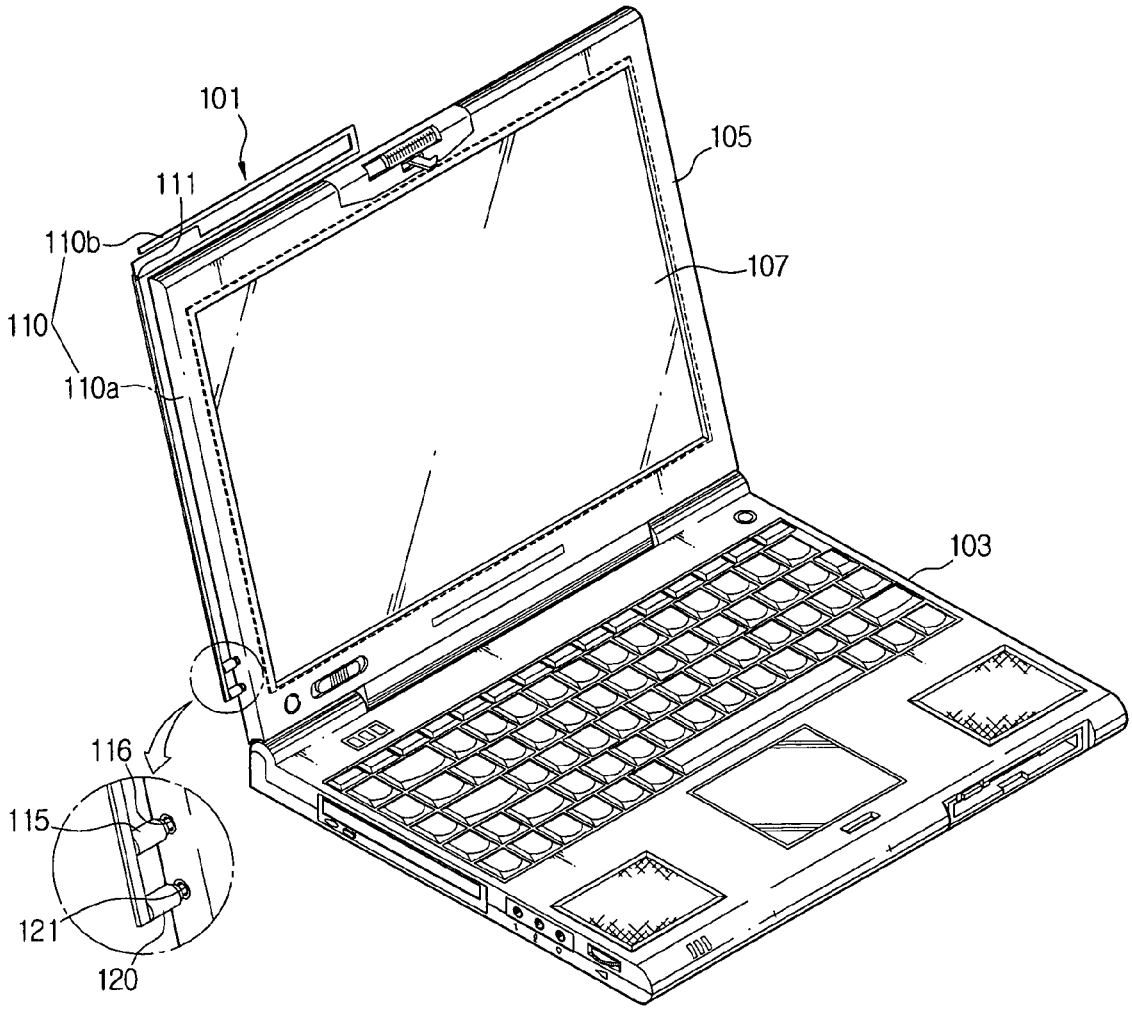
FIG. 3 is a perspective view of a notebook computer to which an antenna is mounted according to another exemplary embodiment of the present invention.

FIG. 3 is a perspective view of a notebook computer having an external antenna according to another exemplary embodiment of the present invention.

The antenna 101 according to another exemplary embodiment of the present invention is detachably attached to the exterior of the notebook computer. The user can attach or detach the antenna 101 to or from the notebook computer if necessary.

The antenna 101 includes a radiating part 110 having a first radiating part 110*a* and a second radiating part 110*b*, a feeding pin 115 for providing current to the radiating part 110, and a shorting pin 120 for forwarding the current from the radiating part 110 to a display panel 107. In this exemplary embodiment, the notebook computer has a main body 103 in which the keyboard is installed.

The feeding pin 115 and the shorting pin 120 are jack-shaped. A pair of plugs 116 and 121 is formed at a cover 105 of the notebook computer for the coupling of the feeding pin 115 and the shorting pin 120. The plugs 116 and 121 are coupled to the display panel 107, respectively. Accordingly, the feeding pin 115 and the shorting pin 120 connected to the plugs 116 and 121 are connected to the display panel 107.

The first radiating part 110*a* and the second radiating part 110*b* are foldably interconnected by a hinge 111. According to one exemplary embodiment of the present invention, the second radiating part 110*b* is rotatable between a folded position and an unfolded position with respect to the first radiating part 110*a*. The second radiating part 110*b* operates through the driving of the hinge motor 40 in one aspect of the exemplary embodiment, whereas the user himself may rotate the second radiating part 110*b* between the folded position and the unfolded position in another aspect of the exemplary embodiment. The user can disconnect the shorting pin 120 from the plug 121 to function as a monopole antenna, when the second radiating part 110*b* is rotated to the unfolded position.

In another exemplary embodiment of the present invention, the user may arbitrarily determine and carry out the rotating of the second radiating part 110*b* and the disconnection of the shorting pin 120 from the plug 121 according to the DMB or DVB-H service state. For instance, when the screen display is not good, the user can personally rotate the second radiating part 110*b* and disconnect the shorting pin 120 from the plug 121.

As such, the antenna 101 is configured to manually change from the PIFA to the monopole antenna.

Figure 4:
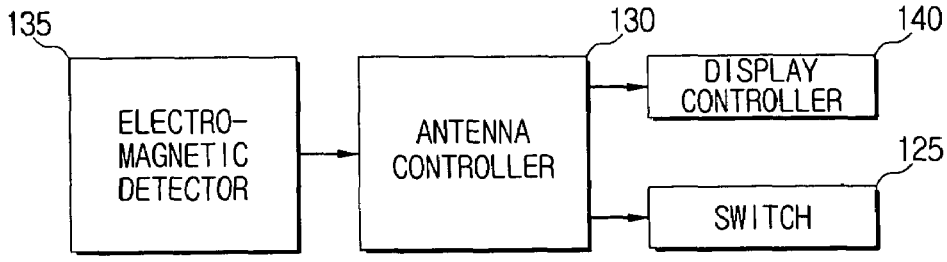
FIG. 4 is a block diagram of a control system of the antenna of FIG. 3 according to another embodiment of the present invention.

Note that the user can determine to rotate the second radiating part 110*b* and disconnect the shorting pin 120 from the plug 121 depending on the magnitude of the DMB or DVB-H signal. For doing so, a control system needs an electromagnetic detector 135, an antenna controller 130, and a display controller 140 as shown in FIG. 4.

The electromagnetic detector 135 detects the magnitude of the DMB or DVB-H signal and provides the detection result to the antenna controller 130, as in the previously described exemplary embodiment.

When the detected magnitude is below a preset level, the antenna controller 130 requests the display controller 140 to display a message instructing the rotation of the second radiating part 110 on a screen. Accordingly, the display controller 140 generates and displays a corresponding message.

Although the user personally disconnects the shorting pin 120 from the plug 121 in this exemplary embodiment of the present invention, a switch 125 may be provided between the plug 121 coupled to the shorting pin 120 and the display panel 107 so as to enable the antenna controller 130 to control ON and OFF of the switch according to the magnitude detected at the electromagnetic detector 135.

In more detail, when the magnitude is below the preset level, the antenna controller 130 requests the display controller 140 to display a message and simultaneously turns off the switch 125. Thus, the user has only to rotate the second radiating part 110*b* to the unfolded position as requested by the displayed message.

In the above exemplary embodiments of the present invention, the second radiating part 10*b* or 110*b* is bendable toward the first radiating part 10*a* or 110*a*. However, other adequate alternatives are also possible. For example, the radiating part 10 or 110 can be configured in a telescopic shape to extend or retract between an interior and exterior of the first radiating part 10*b* or 110*b*.

Figure 5:
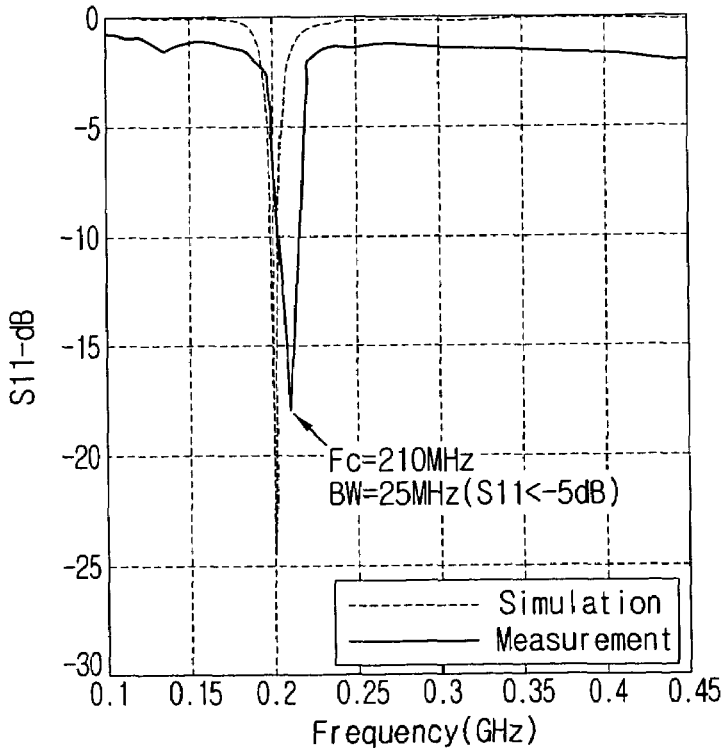
FIG. 5 is a S11 graph when the antenna of the present invention functions as a planar inverted F antenna (PIFA)

FIG. 5 is a S11 graph when the antenna functions as a PIFA.

As shown in FIG. 5, the PIFA forms a pole at the DMB band of 210 MHz. This implies that the electromagnetic waves are radiated in the corresponding band. As the frequency band at −5 dB is 25 MHz, notably, the antenna 101 properly operates even in the DMB band.

Figure 6:
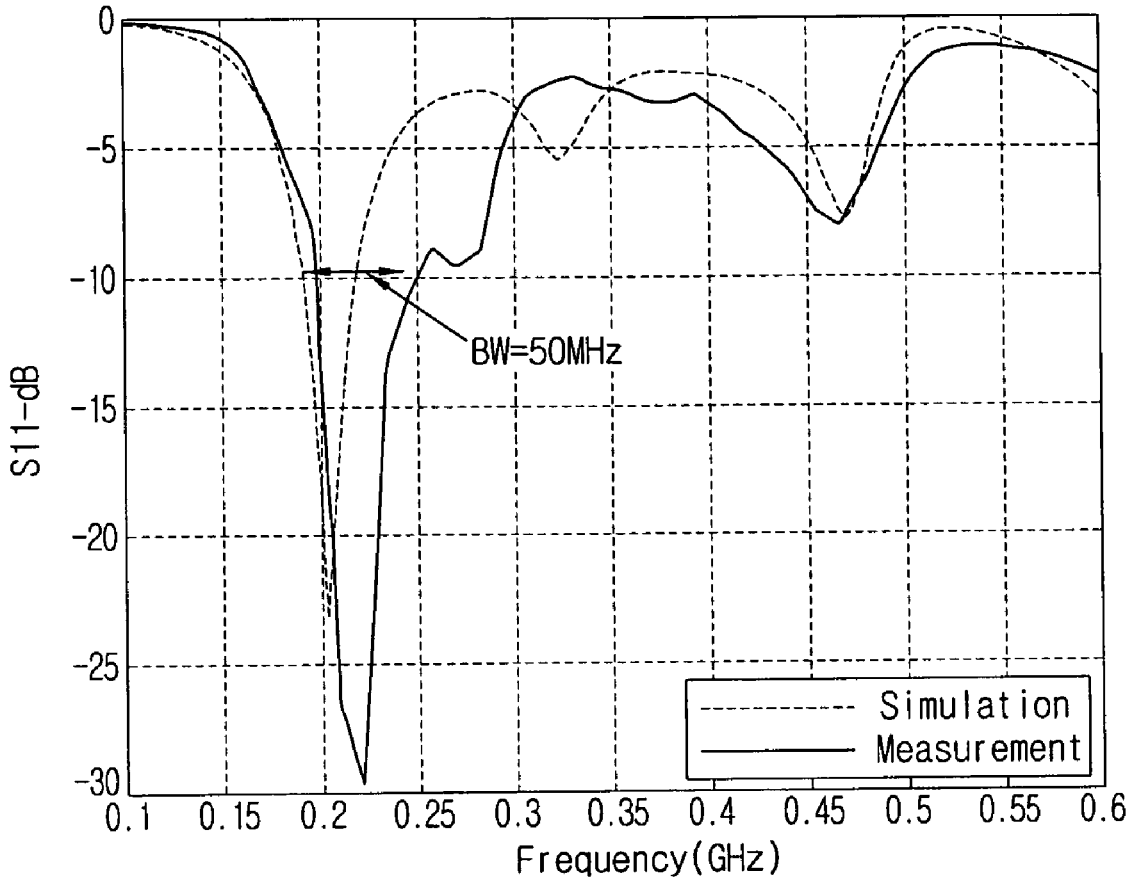
FIG. 6 is a S11 graph when the antenna of the present invention functions as a monopole antenna.

FIG. 6 is a S11 graph when the antenna functions as a monopole antenna.

As shown in FIG. 6, S11 of the monopole antenna forms the pole at about 210 MHz, and the frequency bandwidth at −10 dB is 50 MHz. Thus, it can be seen that the antenna is suitable for the DMB services.

As such, the broadcast receiving antenna 1 or 101 mounted to the wireless terminal has a length which is adjustable according to the electromagnetic strength through the automatic, semiautomatic, and/or manual rotation. At the same time, the antenna 1 or 101 can function as the PIFA in the strong electric field and as the monopole antenna in the weak electric field. Thus, optimum DMB and DVB-H services can be provided. Also, the length of the antenna 1 or 101 can be shortened using the shorter antenna 1 or 101 in the strong electric field. Furthermore, the antenna can be mounted in a device as an Intenna.

In light of the foregoing, the optimum broadcasting services can be provided and the length of the antenna can be shortened by adjusting the length of the antenna according to the magnitude. Afterwards, the antenna may be mounted in devices as an Intenna.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A broadcast receiving antenna which is mounted in a wireless terminal and is bendable to operate as a planar inverted F antenna (PIFA) or a monopole whip antenna according to whether the broadcast receiving antenna is bent or not, said antenna comprising:

a ground;

a radiating part which is in a bar shape and is bendable;

a feeding part which is connected to the ground and provides current to the radiating part; and a shorting part which forwards current circulating the radiating part to the ground.

2. The broadcast receiving antenna of claim 1, wherein the ground is a display panel of the wireless terminal.

3. The broadcast receiving antenna of claim 1, wherein the radiating part includes a first radiating part and a second radiating part which are connected by a hinge, and the first radiating part and the second radiating part are rotatably movable by the hinge between a folded position where the second radiating part is bent toward the first radiating part, and an unfolded position where the first radiating part and the second radiating part are on a same line.

4. The broadcast receiving antenna of claim 3, wherein the first radiating part is placed inside the wireless terminal, and the second radiating part is extendable out of the wireless terminal.

5. The broadcast receiving antenna of claim 1, wherein the radiating part comprises a first radiating part and a second radiating part, and the radiating part further comprises a hinge having a hinge shaft, installed on an area connecting the first radiating part and the second radiating part, and a hinge motor installed to the hinge shaft to rotatably move the radiating part between a folded position where the second radiating part is bent toward the first radiating part and an unfolded position where the first radiating part and the second radiating part are on a same line.

6. The broadcast receiving antenna of claim 1, further comprising:

an electromagnetic detector which detects magnitude of received electromagnetic waves; and an antenna controller which controls an extension of the radiating part according to the magnitude detected by the electromagnetic detector.

7. The broadcast receiving antenna of claim 6, wherein the antenna controller unfolds the radiating part by driving the hinge motor when the magnitude detected by the electromagnetic detector is below a preset level.

8. The broadcast receiving antenna of claim 6, wherein the antenna controller controls the antenna to operate as the monopole antenna by turning off the switch when the radiating part is in the unfolded position.

9. The broadcast receiving antenna of claim 1, wherein a switch is interposed between the shorting part and the ground.

10. A broadcast receiving antenna system mounted to a wireless terminal, comprising:

a radiating part which is in a bar shape and bendable, wherein said radiating part is formed of a first radiating part and a second radiating part, wherein the second radiating part is rotatable with respect to the first radiating part;

a feeding pin which is connected to an end of the first radiating part to provide current to the radiating part, and coupled to a first plug formed to the wireless terminal to connect to a ground; and a shorting pin which is connected to the end of the first radiating part to provide current circulating the radiating part to the ground, connectable to the ground through a second plug formed to the wireless terminal, and connectable to or disconnectable from the ground according to the length of the radiating part.

11. The broadcast receiving antenna system of claim 10, wherein the radiating part further comprises a hinge which connects the first radiating part and the second radiating part to rotatably move the radiating part between a folded position where the second radiating part is bent toward the first radiating part and an unfolded position where the first radiating part and the second radiating part are on a same line.

12. The broadcast receiving antenna system of claim 10, wherein a switch is interposed between the plug coupled to the feeding pin, and the ground.

13. A broadcast receiving antenna system mounted to a wireless terminal, comprising:

a radiating part which is in a bar shape and bendable;

a feeding pin which is connected to an end of the radiating part to provide current to the radiating part, and coupled to a plug formed to the wireless terminal to connect to a ground; and a shorting pin which is connected to the end of the radiating part to provide current circulating part to the ground, connectable to the ground through a second plug formed to the wireless terminal, and connectable to or disconnectable from the ground according to the length of the radiating part;

wherein the radiating part includes a first radiating part and a second radiating part and, the radiating part further comprises a hinge which connects the first radiating part and the second radiating part to rotatably move the radiating part between a folded position where the second radiating part is bent toward the first radiating part and an unfolded position where the first radiating part and the second radiating part are on a same line, wherein the second radiating part has a smaller width than the first radiating part to be accommodated by the first radiating part, and extends or retracts between an interior and an exterior of the first radiating part.

14. A broadcast receiving antenna system mounted to a wireless terminal comprising:

a radiating part which is in a bar shape and bendable;

a feeding pin which is connected to an end of the radiating part to provide current to the radiating part and coupled to a plug formed to the wireless terminal to connect to a ground;

a shorting pin which connected to the end of the radiating part to provide current circulating the radiating part to the ground, connectable to the ground through a second plug formed to the wireless terminal, and connectable to or disconnectable from the ground according to the length of the radiating part;

an electromagnetic detector which detects magnitude of received electromagnetic waves;

an antenna controller which determines whether to unfold the radiating part according to the magnitude detected by the electromagnetic detector; and a display controller which displays a message requesting the extension of the radiating part on a display panel under control of the antenna controller.

15. The broadcast receiving antenna system of claim 14, wherein the antenna controller controls the display controller to display a message which requests the extension of the second radiating part and the disconnection of the shorting pin from the plug when the magnitude detected by the electromagnetic detector is below a preset level.

16. A broadcast receiving antenna system mounted to a wireless terminal, comprising:

a radiating part which is in a bar shape and bendable;

a feeding pin which is connected to an end of the radiating part to provide current to the radiating part, and coupled to a plug formed to the wireless terminal to connect to a ground; and a shorting pin which is connected to the end of the radiating part to provide current circulating the radiating part to the ground, connectable to the ground through a second plug formed to the wireless terminal, and connectable to or disconnectable from the ground according to the length of the radiating part, wherein a switch is interposed between the plug coupled to the feed pin, and the ground, and wherein the antenna controller controls the display controller to display a message which requests the extension of the second radiating part, and turns off the switch when the magnitude detected by the electromagnetic detector is below a preset level.

* * * * *